United States Patent [19]

Castera et al.

[11] Patent Number: 4,621,580

[45] Date of Patent: Nov. 11, 1986

[54] PROCESS OF MANUFACTURING A COLORED SMOKE-GENERATING ARRANGEMENT

[75] Inventors: André Castera, Creuzier Le Vie; Jacques Nicolas, Cheix Sur Morge; Jean Buvat, Chantelle, all of France

[73] Assignee: Manufacture de Machines du Haut-Rhin, S.A., Mulhouse, France

[21] Appl. No.: 434,232

[22] Filed: Oct. 14, 1982

[30] Foreign Application Priority Data

Oct. 14, 1981 [FR] France ..... 81 19317

[51] Int. Cl.[4] ..... F42B 13/44

[52] U.S. Cl. ..... 102/334; 264/3 B; 264/3.1

[58] Field of Search ..... 86/20 C; 264/3 R, 3 B, 264/3 C, 3.1, 3.3, 3.4; 102/334

[56] References Cited

U.S. PATENT DOCUMENTS

| | | | |
|---|---|---|---|
| 3,103,888 | 9/1963 | Rosenthal | 102/334 |
| 3,717,097 | 2/1973 | Wronka et al. | 102/334 |
| 3,884,734 | 5/1975 | Palmer et al. | 102/334 X |
| 4,227,460 | 10/1980 | Krone et al. | 102/334 X |
| 4,276,100 | 6/1981 | Colvin et al. | 264/3 R X |
| 4,291,629 | 9/1981 | Kezer | 102/334 |
| 4,361,526 | 11/1982 | Allen | 264/3 B X |
| 4,407,200 | 10/1983 | Bender et al. | 264/3 C X |

*Primary Examiner*—Peter A. Nelson

[57] ABSTRACT

The present invention concerns a process and an arrangement for manufacturing a smoke emitting arrangement which generates a trace of smoke of predetermined color, red or other color, particularly adapted for use with a spin-stabilized projectile forming a distress or signal flare, and the colored smoke emitting arrangement obtained thereby. The process is characterized in that one obtains a smoke emitting composition by dry-mixing in a pulverulent state a sublimable coloring medium and a pyrotechnic carrier support composition; by distributing the coloring medium between the particles of the carrier support composition; and then placing the end-product (charge), so obtained, into a rigid, fluid-tight housing, which has an opening forming a nozzle oriented along an average predetermined direction, and by compressing the charge in in the interior of this housing in such a way that it is least compressed in the proximity of the nozzle. The so-obtained arrangement for colored smoke emission is particularly suited for use with spin-stabilized projectiles.

17 Claims, 5 Drawing Figures

PROCESS OF MANUFACTURING A COLORED SMOKE-GENERATING ARRANGEMENT

Figure 1:
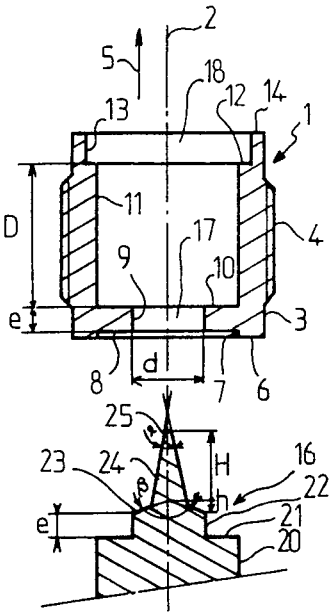

The present invention relates to a manufacturing process for a smoke-producing arrangement which generates traces of smoke of predetermined color, such as red or other colors, and which is adapted to be used in spin-stabilized projectiles which are used as distress or signal flares, as well as the smoke-generating arrangement obtained by the process of the invention.

Until now, the pyrotechnic smoke generating arrangements used with spin-stabilized projectiles (also referred to as gyrating projectiles), emit only a gray smoke or a black very diluted smoke, which emission is based on the pyrotechnical measures and steps taken for producing smoke which are based on the combustion of a carbon-chain composition.

For example, French patent application No. 76 18033 described a black smoke-generating arrangement for spin-stabilized projectiles, of which the pyrotechnical composition is obtained by mixing a smoke-generating composition containing anthracene and a dark ignition composition, which is necessary for combustion; this composition is compressed into a cup which is closed by a washer the diameter of which regulates the smoke emission; the ignition composition being advantageously distributed in alternating layers with respect to the smoke emitting composition for the purpose of keeping the combustion going.

This arrangement emits a black smoke and that is only a black smoke, which is obtained by the combustion of the anthracene of the smoke emitting composition.

The smoke emitted in this fashion has poor visibility characteristics during cloudy and gray days, which is a disadvantage that is encountered each time the emitted smoke is gray or of a very diluted black color, which means each time one utilizes a pyrotechnic technique that is based on combustion of a carbon chain composition.

Such arrangements have the additional disadvantage of being difficult to ignite and having difficulties in maintaining the combustion of the smoke-generating composition, which makes it necessary to incorporate an ignition composition. Such ignition composition is preferably divided into a plurality of layers and due to this fact complicates considerably the manufacture of such arrangements; also the time delay for obtaining a smoke-generation in such arrangement is fairly long.

For example, in U.S. Pat. No. 3,633,512 there is disclosed a projectile which is caused to self-destruct by the action of a combustible tracer mix. However, the organic products disclosed which are used as a modifier of the speed of combustion of the tracer mix emit a smoke colored from black to gray as they are heated within the projectile prior to the ignition of the explosive charge with effects the self-destruction of the projectile.

Colored smoke emitting arrangements are also known, which utilize pyrotechnical techniques. However, such arrangements are only used statically; even if they are incorporated into means such as grenades, rockets, etc., they are only intended to emit colored smoke of predetermined color, such as red or other colors, while the carrier is stationary or is free-falling or is braked.

For example, French patent application No. 77 08623 describes a moldable composition of an organic sublimable coloring medium which has an oxidizing system that is carefully admixed (chlorate, perchlorate, nitrate of guanidine), with a synthetic resin which polymerizes at room temperature, the ignition being assured by a composition of the silicon oxide of copper type.

Such an arrangement has the drawback of making use of a poured cake (similar to a cake of soap or wax) which is characterized by a complicated manufacturing method.

It has the additional drawback of being capable of use only in stationary carrying means, because it appears that if it is mounted in the tail section of a spin-stabilized projectile, such as a shell, it emits a trace of gray or black smoke and none of the expected colored smoke.

One can give this phenomenon the following interpretation:

As the shell progresses, by turning about itself, there is formed at its rear, that is to say precisely in that zone where the smoke emitting arrangement is mounted, a depression wherein there are produced the following concomitant effects:

The acceleration of the combustion velocity of the smoke emitting composition, due to an excessive temperature, leads to almost a complete decomposition of the coloring medium, and not to its sublimation;

to a rarefaction of the air, that is to an insufficient oxidizing atmosphere for oxidizing the carbon links, which results in the destruction of the sublimable coloring medium by the formation of colorless gas.

The invention has eliminated this undesirable formation of black smoke by means of a new concept for a smoke emitting charge, which puts into practice the novel composition, the novel configuration of the charge and the process for fabricating the same.

One of the objects of the invention is to avoid the formation of black smoke when such formation is not desired. In effect an excess of exothermic energy provokes the rupture of the color molecule and depending on the quantity of available oxygen, gives effect to a production of either black carbon (negative balance of oxygen) or a colorless gas $CO+CO_2$ (positive balance of oxygen).

The decomposition of the sublimable coloring medium coupled with an insufficient oxidizing atmosphere can therefore only lead to a strong production of carbon black which makes the coloring medium, which means the formation of excessive gray or black smoke.

In order to avoid the formation of black smoke, when it is not intended, the object of the present invention is to propose a manufacturing process of a smoke emitting arrangement which generates traces of colored smoke of predetermined color, such as red or other colors, and which is more particularly designed for dynamic applications, it being understood that it can also be used for stationary or static applications.

Simultaneously therewith the invention has as an object to mitigate or eliminate other drawbacks of the known smoke-generating arrangements, such as the necessity of providing an ignition composition and the significant time delay of the ignition, which is characterized of those prior art smoke emitting arrangements which use the combustion of a carbon-chain composition; the use of a moldable or castable cake, in case of a static or immobile arrangement, the sublimation temperature of an organic coloring medium, of which is raised higher.

To achieve this object, the invention proposes a smoke emitting arrangement which has the immediate effect of providing a colored smoke based on a single pyrotechnical composition, which is compressed into a cavity.

By using only a smoke-generating composition which is compressible, without a separate ignition composition, facilitates the manufacture of the arrangement considerably; even though there is an absence of an ignition composition, the arrangement of the invention prevents the short time delay before smoke emission, due to the advantageous compression of the composition and it also provides for a long smoke emission due to a good distribution of the coloring medium in the composition.

Most importantly, the arrangement of the invention provides for a truly colored smoke emission, red or other color, and a spin-stabilized projectile equipped with the smoke emission composition of the invention emits within a few seconds a colored smoke trace the persistence of which is assured for a plurality of tens of seconds. In effect the following is obtained: an open granular texture of the carrier composition, the intergranular spaces of which are filled with the sublimable organic coloring medium; the charge of which is obtained by compression of the smoke emitting composition in the form of powder; and the formation of slag is favored by an appropriate choice of the constituent elements of the composition which permits the furnishing of the appropriate quantity of necessary oxygen to heat the composition by combustion without engendering an elevated combustion temperature which would decompose the sublimable coloring medium which it contains, instead of permitting it to sublime itself very rapidly.

It should be noted that the importance of obtaining uniform and porous slags is already known, per se, as well as the possibilities of selecting components which permit the obtaining of such slag, because one knows also that the slag contributes by means of its porosity to regulate the smoke yield and to favor the heat exchange; a man skilled in the art knows how to effect a judicious choice of constituent elements of a pyrotechnic composition to that effect.

The man skilled in the art also knows that when he uses a sublimable organic coloring medium, how to judiciously select the components of the smoke emitting composition which, for reconciling kinematically the combustion and the yield of colored smoke, requires a strongly exothermic composition which entrains the degradation of the coloring medium by combustion, whereas a weakly exothermic composition does not permit to include but a minimal percentage of coloring medium and furnishes only a very mediocre smoke yield, hardly visible, especially when there is a cloudy or dark sky and which also presents difficulties in initiating the smoke emission. A man skilled in the art also knows that it is advantageous to adjust the combustion speed, because a too rapid combustion provokes the destruction of the coloring medium or liberates the smoke too briefly or in a non-workable manner, whereas a slow combustion entrains inversely a smoke yield of reduced importance, which leads to a self extinction; and it is within the state of the art to act upon this effect of the thermodynamics of the reaction by an appropriate choice of the components of the composition and by the conditions of compression of the composition.

In view of the state of the art, the present invention proposes to provide: a spin-stabilized projectile which serves as a signal or distress flare by manufacturing a smoke emitting arrangement for emitting colored smoke which is to be used with such projectile; which is disposed in the interior of a rigid housing, which is fluid-tight, and which includes an opening which forms a nozzle of average predetermined direction; which has a charge of a smoke emitting composition which is obtained by mixing an organic sublimable coloring medium and a pyrotechnic oxidizing composition, the combustion of which is adapted to provoke the sublimation of the coloring medium; the smoke emitting composition is obtained by mixing the organic sublimable medium in the form of a powder and of a carrier pyrotechnic composition, by distributing the coloring medium between the grains of the latter; and by obtaining the charge by placing the composition obtained as described above in a housing and compressing it in the interior of the same in such a way that it is less compressed in the vicinity of the nozzle.

In a preferred embodiment of the manufacturing process the invention proposes to introduce into the charge a central channel which extends the nozzle channel along the direction thereof.

The least compression of the charge in the vicinity of the nozzle, which means towards the end of the channel in this preferred embodiment makes possible to facilitate the initiation of the charge and to reduce the time delay of smoke emission despite the fact that an ignition composition is not present; the provision of a central channel in the charge permits, among other things, to increase the smoke emission as a function of the emitting surface and, thanks to a particular method of procurement of the channel, permits to obtain a predetermined compression gradient of the charge at this level, the adjustment of the formation of the plasma and the heat-equilibrium when the arrangement operates.

The characteristics and advantages of the invention, as well as other characteristics and advantages thereof, will become more apparent from the following description, relative to one embodiment thereof, which is not limiting, as well as in connection with the attached drawings which form an integral part of this description.

FIGS. 1 to 5 illustrate in cross-section, along a plane which includes the axis of the housing or the body of the smoke emitting arrangement, the manufacture of the arrangement of the invention in five successive manufacturing steps.

Reference number 1 indicates the housing, which is made of a rigid, fluid-tight, metallic or non-metallic material, which preferably has a good heat conductivity.

This housing 1 has a peripheral exterior face 3 in the form of a cylinder of revolution about an axis 2 and has a threaded portion 4 which permits the mounting of the housing 1 onto the tail section of a projectile in a position in which the axis 2 coincides with the rotational axis of the spin-stabilized projectile.

Towards the rear, with reference to the direction of travel 5 of the projectile, parallel to the axis 2, the peripheral exterior face 3 of the housing 1 ends at the exterior periphery, axially aligned with the axis 2, of an annular face 6, which is flat, and oriented transversely with respect to the axis 2 and presents an interior periphery, also circular, with respect to the axis 2, which ends at face 7 formed by a cylinder of revolution about the axis 2, which extends from surface 6 forwardly with reference to the direction 5; this surface 7 ends at the exterior periphery, which is circular with respect to the axis 2, of another annular face 8, also flat and oriented transversely with respect to the axis 2, which ends at the interior periphery, circular with respect to the axis 2, of a surface 9 which is formed as a cylinder of revolution about the axis 2 and which is disposed in front of the face 8 relative to the direction 5.

The surface 9 presents a circular front edge with respect to the axis 2, with which it is coaxial and ends at the interior periphery of an annular face 10, facing forwardly, the exterior periphery of which, which is circular and coaxial with respect to the axis 2, and which has a diameter less than that of the exterior periphery 3, and which ends at a cylindrical face 11, which is a surface of revolution about the axis 2, and which is disposed in front of the face 10 and interiorly with respect to the surface 3; towards the front end of the face 11 it presents an edge, which is circular and coaxial with respect to the axis 2, by means of which it abuts at an annular face 12, which is flat and transverse with respect to the axis 2, which presents an exterior periphery which is circular with respect to the axis 2, and which has a diameter which is intermediate between the respective diameters of the cylindrical surfaces 11 and 3; with its exterior periphery the surface 12 is in alignment with a forwardly extending cylindrical surface 13, circular with respect to the axis 2, which surface has a front edge, circular with respect to the axis 2. An annular front surface 13, coaxial with respect to the axis 2 is defined and disposed between the front edges of the cylindrical surfaces 3 and 13, is flat and transverse with respect to the axis 2.

The volume defined at the interior of the housing 1 by the surfaces 10 and 11 and by the plane of the surface 12 is intended to receive the charge 15 as will be described hereinbelow; the thickness of the walls forming the afore-described surfaces, and in particular the thickness of the wall e, which separates the surfaces 8 and 10, is determined by the stresses required for resisting mechanical and thermal loads, which occur during the operation of the arrangement; the surface 9 defines the exterior periphery of a nozzle 17; the diameter d of the opening thereof is defined as a function of the final effects determined by tests, which means conditions that permit a good ignition of the composition by the hot gases liberated at combustion of the propellant powder, and also which assure an acceptable smoke yield, while avoiding the loss of the charge and which take into account the travel of the projectile in the direction 5, and its rotation about the axis 2.

This configuration of the housing does not constitute a limiting embodiment and other forms of housings could be adapted without departing from the gist of the invention.

In the preferred embodiment which has been illustrated, the charging of the housing 1 is achieved by putting into action a counter-punch 16 which moves into the nozzle 17 defined by the surface 9, in order to obturate this nozzle and to provide for a charging from the front end relative to the direction 5, which means via the opening 18 defined by the interior periphery of the annular face 14, which faces forwardly.

The counter-punch 16 presents in the preferred embodiment of the invention, as is illustrated, a form which is not only appropriate to mate interiorly with the surface 9 of the housing 1, but is also appropriate to penetrate towards the interior of the latter for forming a channel 19 at the interior of the charge as will be described hereinbelow.

For this purpose, the counter-punch 16 has a forwardly extending exterior peripheral surface 20, formed as a cylinder of revolution, about a vertical axis which coincides with the axis 2 during filling the housing 1, which diameter is essentially identical to that of the surface 9 in a way so that it matingly fits therein; the surfaces 20 and 22 are joined to each other by means of an annular surface 21, which is flat and oriented transversely with respect to the axis of the punch, in order to bear against the surface 8 when the surfaces 20 and 22 are in mating engagement with the surfaces 7 and 9.

Towards the top, the surface 22 is defined by a circular edge, which is coaxial with respect to the axis of the punch 16, and which edge is disposed at a distance e from the surface 21 in such a way that the upper edge of the surface 22 adjoins the surface 10 while the surface 21 forms a stop with respect to the surface 8.

At the level of this upper edge, the surface 22 adjoins and aligns itself with the exterior periphery of a truncated cone 23, which is a surface of revolution about the axis of the punch 16, the peak of the cone being directed towards the top; the truncated conical surface 23 has an interior peripheral surface which is circular about an axis coinciding with the axis of the punch 16 and by means of which it aligns itself with a second truncated conical surface 24, which is also a surface of revolution about the axis of the punch 16 and which has a summit of a conical surface of of revolution directed towards the top, the summit angle $\alpha$ defines the surface 24 and has a substantially narrower angle than the summit angle $\beta$ of the cone which defines the surface 23; towards the top the surface 24 has a circular front edge the axis of which is that of the punch 16. As one can note that the height H of the surface 25 is so defined that measured in a direction parallel to the axis of the punch 16, it is substantially larger than the height h of the surface 23 measured in the same way, the height H being nearly half that of the distance D which is the distance separating the surfaces 10 and 12 of the housing 1 in a direction parallel to the axis 2; this data is given by way of example and is not to be considered as limiting.

In a first operation for making an arrangement in accordance with the invention the housing 1, the surface 14 of which is facing upwardly and the surface 6 of which is facing downwardly, is placed on the counter-punch 16 in such a way that the surfaces 21 and 22 of the latter engage respectively the surfaces 8 and 9 of the housing 1 and that the tip defined by the surfaces 23, 24, 25 of the counter-punch 16 penetrates into the interior of the housing 1 and defines in the interior of the latter a bulging surface of revolution about the axis 2, whose cross-section decreases towards the top.

Figure 2:
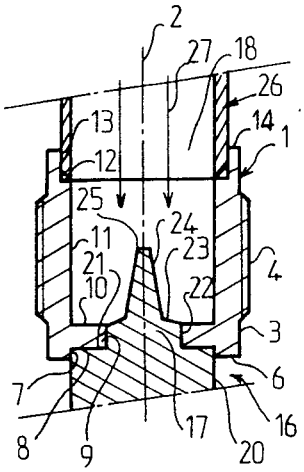

After the housing 1 is closed in this manner at its bottom by the punch 20, as is shown in FIG. 2, one can now proceed to fill the interior with a smoke emitting composition, via the opening 18 which is placed for this purpose beneath a dispensing hopper 26; the filling is illustrated schematically in FIG. 2 by means of descending arrows 27, which are parallel to the axis 2.

The preferred smoke producing compositions will be explained in detail hereinafter, including the manufacturing process for making the same.

Figure 3:
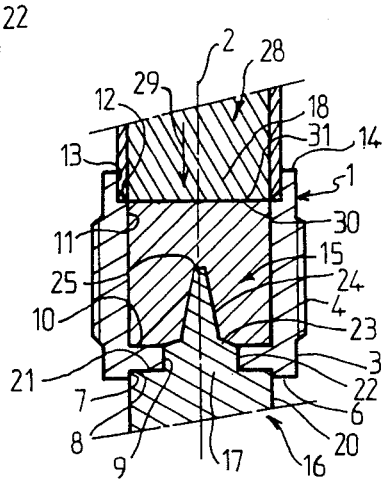

The following step of the process, which is illustrated in FIG. 3, consists, after filling the housing 1, to compress the charge 15 by means of a punch 28 which is introduced from above and moved downwardly, parallel to the axis 2, as is schematically illustrated by the arrow 29, through the opening 18 into the interior of the housing 1 at all times in alignment with the punch 16.

This technique permits to obtain a compression in the charge which decreases in the zones of the charge 15 that are most proximate to the nozzle 17, and which is especially less at the level of the surface 23 and even surface 24 of the punch 16 which protrudes into the interior of the housing 1, which feature facilitates the later ignition of the charge.

The compressive force which is imparted in this way to the charge 15 is such that the charge remains coherent after subsequently the punch 20 is removed.

Preferably, the compression punch 28 has its bottom active surface in the form of a plane 30, transverse with respect to the axis 2, which plane is formed and dimensioned to mate with the shape and transverse dimensions of the surface 11, and which, when the punch 28 assumes the position most proximate to the counterpunch 16, is positioned in the same plane as the surface 12 of the housing 1; thus, in the next phase of the process the pressure of the punch 28 is relieved, the charge 15 forms on its top a top plane surface 31, which is oriented transversely with respect to the axis 2 and which is coplanar with the surface 12.

Figure 4:
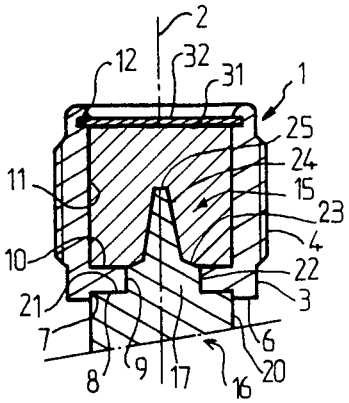
Figure 5:
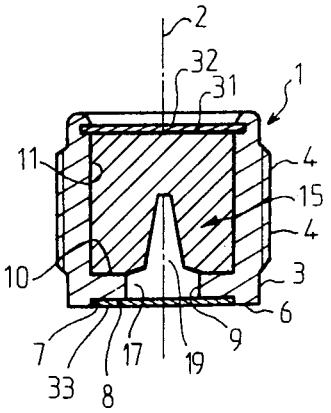

In the following phase of the process, illustrated in FIG. 4, this surface 31 and the surface 12 receive respectively the central and the peripheral portion of a metallic disc or a disc of fire-retardent material 32, which is essentially defined by two planar surfaces disposed transversely with respect to the axis 2; this disc 32 is thereafter rigidly mounted on the housing 1 by means of crimping, which means by turning down the peripheral portion of the housing 1 which is initially situated between the surfaces 13 and 3 of the housing, in order to close the opening 12 in a fluid-tight manner or not.

In a following process step, the housing 1, the opening 18 of which is now closed by the disc 32, is disengaged from the punch 16, which leaves an exposed interior face of the charge 15 and the channel 19 which have configurations complementary to that of the protrusion which has formed the channel 19 in the interior of the housing 1, which means a configuration of a blind bore which increases in diameter from a central portion of the charge 15 towards the nozzle 17 defined by the surface 9 of the housing 1, in the shape of a truncated cone of revolution about the axis 2, that is first with a small summit angle which extends along the major length of the channel 19 with respect to the axis 2, and thereafter in the immediate vicinity of the nozzle 17 with a larger summit angle.

After the punch 16 has been retracted, it is possible to obdurate the nozzle 17 by means of a disc 33, for example made out of nitrocellulose material, which is inserted and fixed by means of a defined thrust into the interior of the annular face 6, in the recess defined by the surfaces 7 and 8 of the housing 1.

The housing 1 can be screwed into by means of its exterior threaded portion 4 into an operative position on a non-illustrated carrier projectile.

It should be noted that the sequence of steps for closing the opening 18 by means of the disc 32, for retracting the punch 16 and for closing the nozzle 17 by means of the disc 33 could be modified and such modification is not considered to be without the scope of the invention; for example the punch 16, 20 could be removed for positioning and clamping the disc 32, this positioning and clamping may therefore be effected prior to, simultaneous or subsequent to the positioning of the disc 33.

In accordance with the invention, the smoke producing composition which is used as the constituent for the charge 15 is obtained by means of a dry-mix, which means a mix in a pulverulent state; 35 to 50% of the weight being formed by an organic sublimable coloring medium and the remainder for complementing the 100%, that is 65 to 50% of the weight is formed by a pyrotechnical carrier composition; the chemical reaction of the elements of this composition produces the necessary energy for sublimating the coloring medium, and entrains as a result of this the formation of smoke or traces of smoke of the desired color.

The inventive composition disposes of the double concern to modulate the chemical reaction in particular to regulate the temperature of the plasma for controlling thereby the sublimation conditions of the coloring medium and to permit the elimination of all types of ignition compositions, and assuring when combustion occurs, that solid slag forms, which is resistant and porous, and at the same time favors the evacuation of the smoke and the heat dissipation. One has obtained good results with tests of a support or carrier composition of the type containing the following:

A first element of the group of earth-alkaline-peroxides:

a second element from the group of earth-alkaline nitrates;

a third element from the group of earth-alkaline sulphates; and a fourth organic element which forms an agglomeration of the three previous elements and which is taken from the group of resinate or other organic material such as alginate, guaranate . . . etc.

In particular one has received good results with a carrier or support composition containing the following:

From 45 to 80% of an oxide of the group of peroxides of barium, strontium or lead;

from 10 to 40% of a mixture of compositions of the group of nitrate-sulphate of barium or strontium;

3 to 20% of an organic binder belonging to the family of resinates of calcium or sodium; these numbers of percentages represent weight percentages with respect to the weight of the carrier composition.

According to a preferred manufacturing process, this base composition is formed by mixing the oxidants, thereafter enclosing it by means of an organic binder previously placed in solution with an appropriate solvent, thereafter it is granulated and dried.

The composition which is obtained has a grain size less than 600 microns, which is thereafter mixed in a dry state with the sublimable organic coloring medium, which is in an atomized state, in such a way that the latter, in view of its important increase in bulk, distributes itself into the carrier composition, having a specific gravity in a non-squeezed state of the order of about 1.

The mixture thus obtained is introduced into the housing 1 in the phase of the process which is illustrated in FIG. 2; it is thereafter compressed as is described with respect to FIG. 3.

The charge 15 now exhibits an apparent average specific gravity in the order of 1.5 to 2.1, which demonstrates that the sublimable coloring medium is disposed in a porous open texture constituted by the grains of the support carrier composition, the granular character of which is very clearly superior to that of the sublimable coloring medium.

This renders the advantage that when sublimating, the coloring medium liberates a large quantity of empty spaces thereby increasing the speed by which the porosity of the residue is formed; this brings about the formation of heat exchange over a large contact surface facilitating the evacuation of the smoke and the formation of heat in excess of the plasma heat.

In addition thereto, one of the advantages of the composition in accordance with the invention resides in the employment of a coloring medium as a heat conduct inhibitor; in effect, the coloring medium does not react chemically with the other elements but, in order to sublimate itself, absorbs a fraction of the enthalpy of the reaction, thereby preventing by this fact an exceeding of the critical temperature above which it would decompose itself.

It is of course understood that the compositions set forth hereinabove are only given by way of example and are not considered to be limitative for use with the invention; one does not therefore leave the scope of the invention by using other similar combinations of other compositions.

Test have nevertheless enabled the inventors to tabulate the good results obtained with such combinations, the coloring media which were used are of the type that are manufactured by PECHINEY UGINE KUHLMANN and are marketed under the tradename "ORGANOL". There are set forth hereinbelow three examples, which are not limiting, of smoke producing compositions, which have been used in accordance with the invention, and which have given good results:

EXAMPLE 1

A composition for red smoke.

The coloring medium used is vermillon ORGANOL of 45 weight percent, mixed in a dry state with 55% of a support carrier composition, which gives 100 g of red smoke-emitting material:

| | |
|---|---|
| strontium peroxide | 36.3 g |
| barium sulphate | 8.2 g |
| barium nitrate | 5.5 g |
| calcium resinate | 5.0 g |
| vermillon ORGANOL | 45.0 g |

The average apparent density after compression (specific gravity) of this composition is in the order of 1.6 to 1.8.

This smoke producing arrangement in accordance with the invention emits, as soon as the projectile leaves the gun barrel, a trace of red smoke, which is clear and visible in a dark or gray sky background.

EXAMPLE 2

A composition of orange or yellow smoke, this composition is obtained by replacing in the same proportion the vermillon ORGANOL respectively by a yellow ORGANOL PC or an orange ORGANOL (P.U.K), one obtains analogous results, with the understanding that a strong yield of yellow-green smoke or orange smoke is obtained.

The average apparent density (specific gravity) of such a composition after compression is in the order of 1.5 to 1.8.

EXAMPLE 3

A composition of blue or green smoke.

The coloring media utilized in this case are derived from anthraquinones. An adaptation of the respective percentages of the coloring medium and the support or carrier composition is necessary. The best result is obtained by a mixture 50/50 of coloring medium/composition, which permits the obtaining of a very intense green or blue trace;

for 100 g of the smoke producing composition:

| | |
|---|---|
| strontium peroxide | 33.0 g |
| barium nitrate | 5.0 g |
| barium sulphate | 7.5 g |
| calcium resinate | 4.5 g |
| blue vif Organol J.N. | 50.0 g |
| or | |
| green Organol solid J (produced by Chemical Products of Ugine Kuhlmann) PCUK | |

After compression the apparent average density (specific gravity) of this composition is of the order of 1.75 to 2.1.

These examples are not limiting; by appropriately combining the sublimable coloring media one can obtain a trace of any kind of color.

On the other hand, by adjusting the percentage of coloring medium-support carrier composition, it is possible to obtain other smoke producing compositions which when compressed in accordance with the previously described technique, give off colored smokes which are highly visible.

Although the invention is illustrated and described with reference to a plurality of embodiments, it is to be expressly understood that it is in no way limited to the disclosure of such preferred embodiments but is capable of numerous modifications within the scope of the appended claims.

We claim:

1. A process for manufacturing a smoke producing arrangement which generates a trace of smoke of a predetermined distinctive color, and which is particularly adapted to be used in conjunction with a spin-stabilized projectile such as a signal or distress flare projectile, said projectile including a rigid housing which is fluid-tight and which has an opening forming a nozzle which is oriented along an average predetermined direction opposite to the direction of flight of the projectile, the smoke producing composition being the combination of an organic sublimable coloring medium and a pyrotechnic oxidizing support carrier composition the combustion of which is adapted to cause the sublimation of the coloring medium, comprising forming the smoke producing composition by mixing, in a pulverulent state, a sublimable organic coloring medium and a pyrotechnic carrier composition, and distributing the coloring medium between the particles of the carrier composition in such a way that the mixture has an average specific gravity of about 1; the composition so obtained placing this mixture into the housing of a projectile having a nozzle; and by variably compressing it into the interior of the housing so that a charge having an appropriate texture for a rapid sublimation of the coloring medium is obtained and which charge is least compressed in the vicinity of the nozzle.

2. A process according to claim 1, wherein the specific gravity of the compressed charge in the housing is on the order of 1.5 to 2.1.

3. A process according to claim 1, wherein the smoke producing composition is obtained by mixing in a dry state 35 to 50 weight percent of the charge of an organic sublimable coloring medium with a pyrotechnical support carrier composition the weight percentage of the charge of which is 65 to 50 weight percent.

4. A process according to claim 3, wherein the carrier suppor composition comprises:

a first element chosen from the group of alkaline-earth peroxides;

a second element chosen from the group of alkaline-earth nitrates;

a third element chosen from the group of alkaline-earth sulphates;

a fourth element, which is a binding material for the previous three elements which are mixed, such fourth element being a resinate.

5. A process according to claim 4, wherein the carrier support composition contains strontium peroxide, barium nitrate, barium sulphate, and calcium resinate.

6. Process according to claim 5, wherein the carrier support composition comprises:

45 to 80 weight percent of an oxide chosen from the group consisting of barium peroxide, strontium peroxide or lead peroxide;

10 to 40 weight percent of a mixture of compounds chosen from the group consisting of nitrate-sulphates of barium and nitrate sulphates of strontium;

3 to 20 weight percent of an organic binder chosen from the group consisting of compounds of calcium and sodium resinates; the above quantities being in weight percentages with respect to the weight of the support carrier composition.

7. A process according to claim 1, wherein a central channel is provided in the charge thereby extending the nozzle in the direction axially of the projectile.

8. A process according to claim 7, wherein the composition is placed into a housing which has an opening opposite to and aligned with the nozzle, thereafter compressing the composition in the interior of the housing by means of a punch which is introduced via the said opening in the housing, provisionally closing the nozzle by a counter-punch, and thereafter closing the opening by rigid means.

9. A process in accordance with claim 8, wherein the counterpunch has a configuration such that it forms a channel in the shape of a blind bore, and in that for provisionally closing the nozzle after the compression of the composition in the interior of the housing the counter punch is introduced into the housing via the nozzle along the said axial direction before introducing the punch into the housing via said opening.

10. A process according to claim 9, wherein the counter-punch is introduced into the housing via the nozzle before the composition is placed into the housing.

11. A process according to claim 7, wherein the cross-section of the channel decreases from the nozzle towards the interior of the housing.

12. A process according to claim 11, wherein the channel has a configuration which is at least partially frusto-conical forming a surface of revolution coaxial of the nozzle.

13. A process according to claim 11, wherein the channel has a first zone immediately adjacent the nozzle and a second zone situated above the first zone, the second zone being disposed further from the nozzle in an axial direction, the first of said zones having a transverse cross-section which decreases more rapidly than the cross-section of the second of said zones in the ratio of their respective distances from the nozzle.

14. A process according to claim 13, wherein the first and second zones form frusto-conical surfaces of revolution disposed coaxial of the nozzle, the apex angle of the cone corresponding to the first frusto-conical surface forming the first zone being larger than the apex angle of the second frusto-conical surface corresponding to the second zone.

15. A process according to claim 7, wherein the channel terminates in the interior of the charge.

16. A smoke producing arrangement which generates a trace of smoke of a predetermined distinctive color, and which is particularly adapted to be used in conjunction with a spin-stabilized projectile such as a signal or distress flare projectile, said projectile including a rigid housing which is fluid-tight and which has an opening forming a nozzle which is oriented along an average predetermined direction opposite to the direction of flight of the projectile, the smoke producing composition being the combination of an organic sublimable coloring medium and a pyrotechnic oxidizin support carrier composition the combustion of which is adapted to cause the sublimation of the coloring medium, the smoke producing composition having been formed by mixing, in a pulverulent state, a sublimable organic coloring medium and a pyrotechnic carrier composition, and distributing the coloring medium between the particles of the carrier composition in such a way that the mixture has a specific gravity of about 1, and then the mixture is placed into the housing of a projectile having a nozzle and variably compressing it into the interior of the housing so that a charge having an appropriate texture for a rapid sublimation of the coloring medium is obtained and which charge is least compressed in the vicinity of the nozzle.

17. A smoke producing arrangement according to claim 16, wherein the smoke producing composition is obtained by mixing in a dry state 35 to 50 weight percent of the charge of an organic sublimable coloring medium with a pyrotechnical support carrier composition the weight percentage of the charge of which is 65 to 50 weight percent.

* * * * *